US009631455B2

(12) United States Patent
Geiger et al.

(10) Patent No.: US 9,631,455 B2
(45) Date of Patent: Apr. 25, 2017

(54) SUBSEA ACTUATION SYSTEM

(75) Inventors: David Geiger, Orchard Park, NY (US); Raymond S. Scheffler, Holland, NY (US)

(73) Assignee: Moog Inc., East Aurora, NY (US)

( * ) Notice: Subject to any disclaimer, the term of this patent is extended or adjusted under 35 U.S.C. 154(b) by 119 days.

(21) Appl. No.: 14/002,003

(22) PCT Filed: Mar. 6, 2012

(86) PCT No.: PCT/US2012/027852
§ 371 (c)(1),
(2), (4) Date: Aug. 28, 2013

(87) PCT Pub. No.: WO2012/122159
PCT Pub. Date: Sep. 13, 2012

(65) Prior Publication Data

US 2013/0333894 A1 Dec. 19, 2013

Related U.S. Application Data

(60) Provisional application No. 61/449,740, filed on Mar. 7, 2011.

(51) Int. Cl.
*E21B 34/04* (2006.01)
*E21B 33/035* (2006.01)
(Continued)

(52) U.S. Cl.
CPC ..... *E21B 34/04* (2013.01); *E21B 33/0355* (2013.01); *F15B 7/006* (2013.01);
(Continued)

(58) Field of Classification Search
CPC . E21B 33/0355; E21B 33/064; E21B 41/0007
(Continued)

(56) References Cited

U.S. PATENT DOCUMENTS 3,572,032 A * 3/1971 Terry ..... 60/398
3,677,001 A 7/1972 Childers et al.
(Continued)

FOREIGN PATENT DOCUMENTS

EP 1138872 A1 4/2001
GB 2057579 A 4/1981
(Continued)

OTHER PUBLICATIONS

The International Search Report (ISR) and Written Opinion of the International Searching Authority for International Application No. PCT/US2012/027852; Publication No. WO 2012/0122159; dated Jun. 18, 2013.

(Continued)

*Primary Examiner* — Matthew R Buck
*Assistant Examiner* — Aaron Lembo
(74) *Attorney, Agent, or Firm* — Rowlands Richards, Esq.; Harter Secrest & Emery LLP

(57) ABSTRACT

A subsea drilling, production or processing actuation system comprising a variable speed electric motor (10) adapted to be supplied with a current, a reversible hydraulic pump (8, 28) driven by the motor, a hydraulic piston assembly (92, 101, 111, 121, 131) connected to the pump and comprising a first chamber (2), a second chamber (3) and a piston (4) separating the first and second chambers and configured to actuate a valve (91) in a subsea system, a fluid reservoir (14) connected to the pump and the hydraulic piston assembly, the pump, hydraulic piston assembly and reservoir connected in a substantially closed hydraulic system, and a pressure compensator (13, 65) configured to normalize pressure differences between outside the hydraulic system and inside the hydraulic system.

24 Claims, 6 Drawing Sheets

(51) Int. Cl.
*F15B 7/00* (2006.01)
*F15B 15/18* (2006.01)

(52) U.S. Cl.
CPC ..... *F15B 15/18* (2013.01); *F15B 2211/20515* (2013.01); *F15B 2211/20538* (2013.01); *F15B 2211/20561* (2013.01); *F15B 2211/27* (2013.01); *F15B 2211/625* (2013.01); *F15B 2211/6313* (2013.01); *F15B 2211/6336* (2013.01); *F15B 2211/7053* (2013.01); *F15B 2211/785* (2013.01)

(58) Field of Classification Search
USPC ..... 166/344, 363
See application file for complete search history.

(56) References Cited

U.S. PATENT DOCUMENTS 3,680,311 A * 8/1972 Harbonn et al. ..... 60/404
3,933,338 A 1/1976 Herd et al.
4,176,722 A * 12/1979 Wetmore et al. ..... 175/7
4,347,900 A * 9/1982 Barrington ..... 166/380
4,505,115 A 3/1985 Arbuckle
4,509,405 A 4/1985 Bates
4,622,884 A 11/1986 Buchl
4,789,313 A 12/1988 Tower et al.
5,047,990 A * 9/1991 Gafos et al. ..... 367/6
5,062,349 A 11/1991 Khan
5,901,633 A 5/1999 Chan et al.
6,102,673 A * 8/2000 Mott et al. ..... 417/392
6,142,059 A 11/2000 Chan et al.
6,192,680 B1 * 2/2001 Brugman et al. ..... 60/398
6,250,199 B1 6/2001 Schulte et al.
6,651,749 B1 11/2003 Kilgore
7,137,450 B2 * 11/2006 Johansen et al. ..... 166/316
7,159,662 B2 * 1/2007 Johansen et al. ..... 166/374
7,287,595 B2 * 10/2007 Johansen et al. ..... 166/321
7,398,830 B2 * 7/2008 Johansen et al. ..... 166/321
7,635,029 B2 * 12/2009 MacDougall et al. ..... 166/363
8,322,427 B2 * 12/2012 Inderberg et al. ..... 166/336
8,596,608 B2 * 12/2013 Grimseth et al. ..... 251/69
8,857,175 B2 10/2014 Geiger
2003/0037544 A1 2/2003 Armstrong
2005/0173667 A1 8/2005 Zheng
2006/0239840 A1 10/2006 Hembree
2008/0264646 A1 * 10/2008 Sten-Halvorsen et al. ... 166/360
2011/0088913 A1 * 4/2011 Baugh ..... 166/374
2012/0043089 A1 * 2/2012 Hoffman et al. ..... 166/340
2012/0087808 A1 * 4/2012 Aalburg ..... F04C 19/002 417/68
2015/0104328 A1 * 4/2015 Babbitt ..... F04D 13/086 417/2

FOREIGN PATENT DOCUMENTS

GB 2275969 A 9/1994
GB 2373546 A 9/2002
WO WO2007045260 A1 4/2007

OTHER PUBLICATIONS

The International Preliminary Report on Patentability Chapter I for International Application No. PCT/US2012/027852; Publication No. WO 2012/122159; dated Sep. 10, 2013.

* cited by examiner

SUBSEA ACTUATION SYSTEM

TECHNICAL FIELD

The present invention relates generally to the field of subsea drilling, processing and production equipment, and more particularly to an improved subsea actuation system for such equipment.

BACKGROUND ART

In subsea oil and gas exploration, the drilling system or wellhead may be located many thousands of feet below the sea surface. Specialized equipment is therefore used to drill, produce and process oil and gas on the sea floor, such as subsea trees, processing systems, separators, high integrity pipeline protection systems, drills, manifolds, tie-in systems and production and distribution systems. Such equipment is commonly controlled by a number of types of valves, including blow-out preventers to stop the unintended discharge of hydrocarbons into the sea.

With existing systems, such valves are typically operated hydraulically by providing pressurized hydraulic fluid from a surface vessel down to the wellhead. Large hydraulic power lines from vessels or rigs on the ocean surface feed the ocean floor drilling, production and processing equipment, and the many subsystems having valves and actuators. However, such lines are expensive to install and maintain and in some cases may not be feasible, such as at depths over 10,000 feet or under the arctic circle ice caps.

Accordingly, it would be desirable to provide an actuator that would not require such an umbilical connection from the surface and that would still operate with the desired force and functionality.

BRIEF SUMMARY OF THE INVENTION

With parenthetical reference to corresponding parts, portions or surfaces of the disclosed embodiment, merely for the purposes of illustration and not by way of limitation, the present invention provides a subsea drilling, production or processing actuation system comprising a variable speed electric motor (10) adapted to be supplied with a current, a reversible hydraulic pump (8, 28) driven by the motor, a hydraulic piston assembly (92, 101, 111, 121, 131) connected to the pump and comprising a first chamber (2), a second chamber (3) and a piston (4) separating the first and second chambers and configured to actuate a valve (91) in a subsea system, a fluid reservoir (14) connected to the pump and the hydraulic piston assembly, the pump, hydraulic piston assembly and reservoir connected in a substantially closed hydraulic system, and a pressure compensator (13, 65) configured to normalize pressure differences between outside the hydraulic system and inside the hydraulic system.

The subsea system may further comprise a failsafe mechanism (98). The fail-safe mechanism may comprise a spring element (36) biasing the piston in a first direction. The fail-safe mechanism may comprise a fail-safe valve (35) between the first chamber and the second chamber or between the second chamber and the reservoir and the fail-safe valve may be arranged to open in the event of a power failure allowing equalization of fluid pressure in the first and second chamber on each side of the piston. The fail-safe mechanism may comprise a two-stage actuator.

The subsea system may further comprise a filter between the pump and the hydraulic piston assembly.

The electric motor may comprise a brushless DC motor, or may be selected from a group consisting of a stepper motor, brush motor and induction motor. The hydraulic pump may be selected from a group consisting of a fixed displacement pump, a variable displacement pump, a two-port pump, and a three-port pump. The pump may comprise a two-port pump (8) or a three-port pump (28). The piston may comprise a first surface area exposed to the first chamber and a second surface area exposed to the second chamber. The first surface area (4*c*) may be substantially equal to the second surface area (4*b*). The first surface area (4*a*) may be substantially different from the second surface area (4*b*).

The hydraulic piston assembly may comprise a cylinder (1) having an first end wall (1*b*) with the piston disposed in the cylinder for sealed sliding movement therealong, and a first actuator rod (5) connected to the piston for movement therewith and having a portion sealingly penetrating the first end wall. The cylinder may have a second end wall (1*a*) and the hydraulic piston assembly may comprise a second actuator rod (5*a*) connected to the piston for movement therewith and having a portion sealingly penetrating the second end wall.

The valve may comprise a stop valve in a subsea blow-out preventor, and the stop valve may comprise a shearing ram. The valve may comprise a control valve in a subsea production or processing system.

The pressure compensator may comprise a membrane (15) in the fluid reservoir (13). The pressure compensator may comprise a piston (67) in a cylindrical housing (66).

The valve may be in an assembly selected from a group consisting of a subsea blow-out preventer, a subsea production tree or wellhead system, a subsea processing or separation system, a subsea tie-in system, a subsea chock, a subsea flow module or a subsea distribution system. The subsea system may further comprise blocking valves operatively arranged to selectively isolate the pump from the first and second chambers. The subsea system may further comprise a position sensor (40) configured to sense the position of the piston. The subsea system may further comprise a pressure sensor (41, 42) configured to sense pressure in the first or second chamber.

DETAILED DESCRIPTION OF THE PREFERRED EMBODIMENTS

Figure 1:
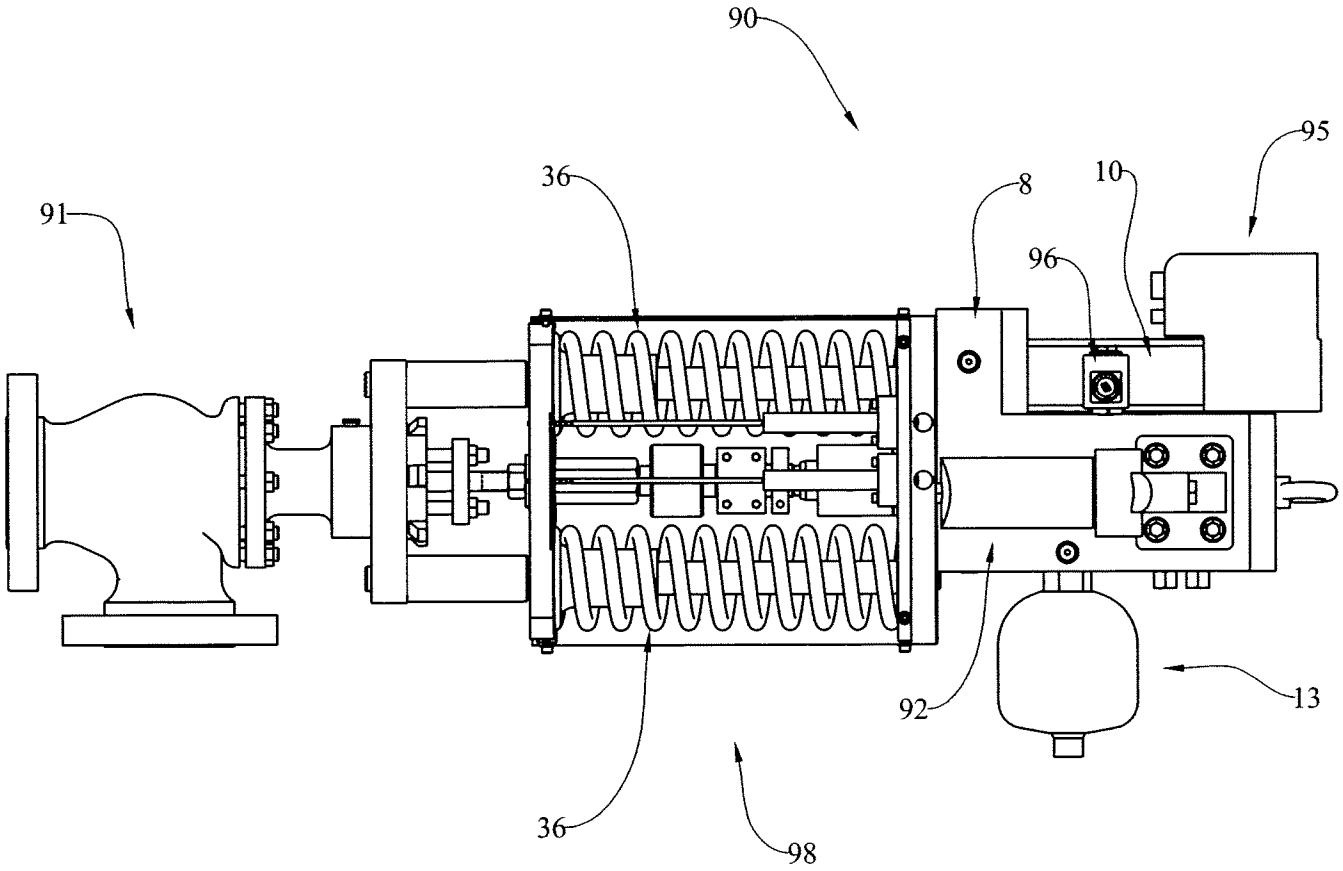
FIG. 1 is a component view of a fail-safe embodiment of the subsea actuation system operating a valve in a subsea oil processing line.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring now to the drawings, and more particularly to FIG. 1 thereof, the present invention broadly provides a subsea actuation system for a subsea valve, of which an embodiment is indicated at 90. As shown in FIG. 1, assembly 90 is adapted to actuate a subsea process valve 91 or other type of valve or similar component in a subsea environment. FIG. 1 shows the control valve architecture with a pressure compensated canister that protects the spring assembly. In this embodiment, subsea fluid such as oil or gas is metered by process valve 91 and the forces required to meter valve 91 are created by subsea actuator system 90, which includes piston actuator assembly 92, integrated bidirectional pump 8, variable speed bidirectional electric servomotor 10, electronic motor controller 95, fluid logic elements/check valves 96, reservoir/compensator 13, and spring failsafe assembly 98. Spring failsafe assembly 98, depending on the design requirements, will drive process valve 91 in a failed close or a failed open condition when power is lost. Motor controller 95 includes drive electronics to commutate motor 10 and receives feedback from sensors in the system and controls motor 10 accordingly.

Figure 2:
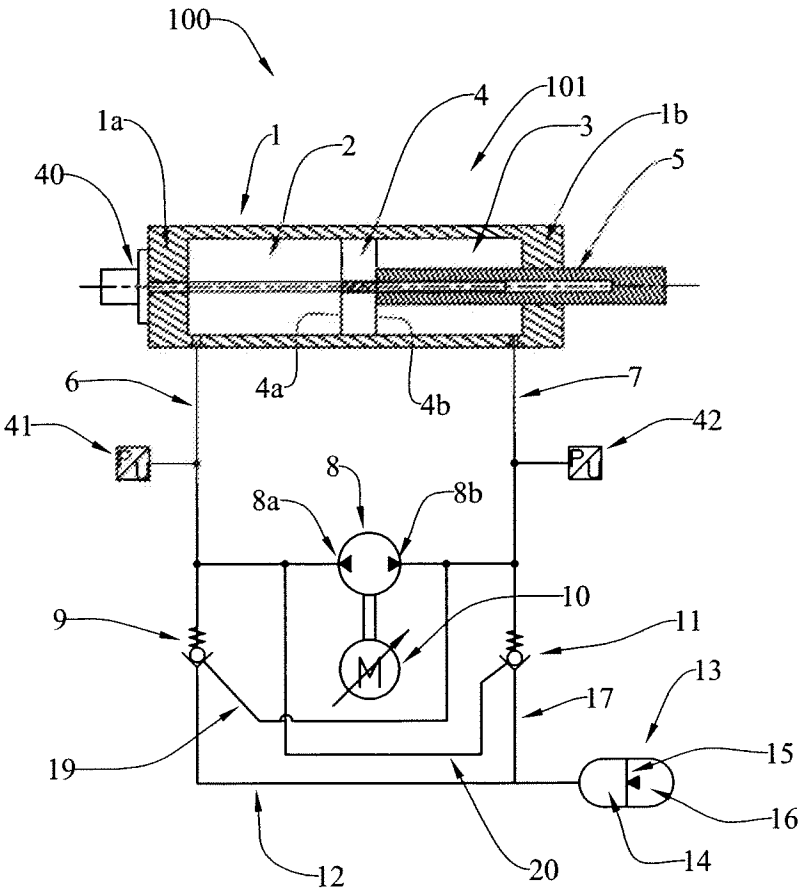
FIG. 2 is a detailed schematic view of a first embodiment of the subsea actuation system shown in FIG. 1, this view showing an unequal piston area with anti-cavitation form.

FIG. 2 shows an embodiment 100 of the subsea actuation system. As indicated, system 100 includes variable speed electric motor 10, bi-directional or reversible pump 8 driven by motor 10, hydraulic piston assembly 101, system pressure compensated reservoir 13 with system fluid tank 14, pressure transducers 41 and 42 that feed back to motor 10 controller 95, and position transducer 40 that feeds back to motor controller 95. Pump 8, piston assembly 101 and tank 14 are connected by a plurality of hydraulic flow lines 6, 7, 12, 17, 19 and 20 to form a closed fluid system.

Figure 8:
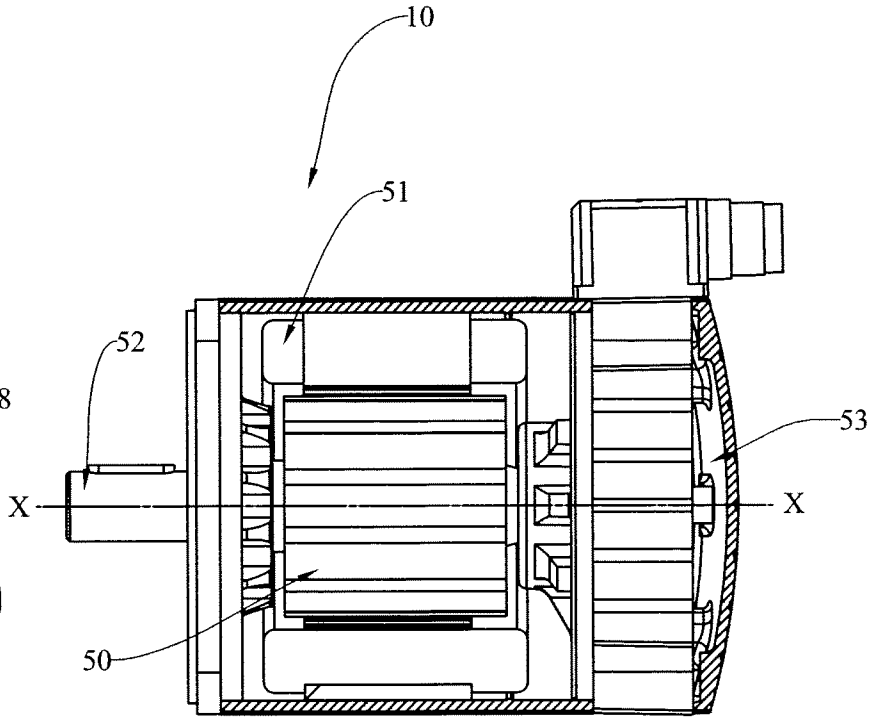
FIG. 8 is a cross-sectional view of the electric variable-speed servo-motor shown in FIG. 2.

As shown in further detail in FIG. 8, in this embodiment motor 10 is a brushless D.C. variable-speed servo-motor that is supplied with a current. Motor 10 has an inner rotor 50 with permanent magnets and a fixed non-rotating stator 51 with coil windings. When current is appropriately applied through the coils of stator 51, a magnetic field is induced. The magnetic field interaction between stator 51 and rotor 50 generates torque which may rotate output shaft 52. There are no mechanical brushes that commutate the stator fields in this embodiment of the motor. Drive electronics, based on resolver 53 angular position feedback, generate and commutate the stator fields to vary the speed and direction of motor 10. Accordingly, motor 10 will selectively apply a torque on shaft 52 in one direction about axis x-x at varying speeds and will apply a torque on shaft 52 in the opposite direction about axis x-x at varying speeds. Other motors may be used as alternatives. For example, a variable speed stepper motor, brush motor or induction motor may be used.

Figure 7:
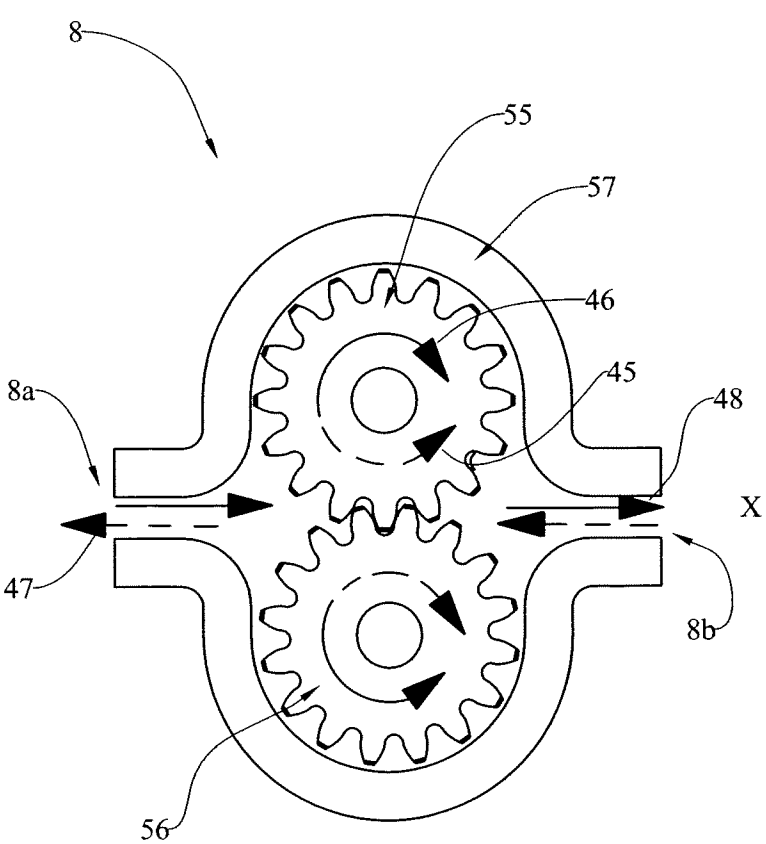
FIG. 7 is a cross-sectional view of the bi-directional pump shown in FIG. 2.

As shown in further detail in FIG. 7, in this embodiment pump 8 is a fixed displacement bi-directional internal two-port gear pump. The pumping elements, namely gears 55 and 56, are capable of rotating in either direction, thereby allowing hydraulic fluid to flow in either direction 47 or 48. This allows for oil to be added into and out of the system as the system controller closes the control loop of position or pressure. The shaft of gear 55 is connected to output shaft 52 of motor 10, with the other pump gear 56 following. Fluid is directed to flow to the outside of gears 55 and 56, between the outer gear teeth of gears 55 and 56 and housing 57, respectively. Thus, rotation of gear 55 in clockwise direction 46 causes fluid flow in one direction 48, from port **8*a* out port 8*b*. Rotation of gear 55 in counterclockwise direction 45 cause fluid flow in opposite direction 47, from port 8*b* out port 8*a*. Thus, the direction of flow of pump 8 depends on the direction of rotation of rotor 50 and output shaft 52 about axis x-x. In addition, the speed and output of pump 8 is variable with variations in the speed of motor 10**. Other bi-directional pumps may be used as alternatives. For example, a variable displacement pump may be used.

Figure 9:
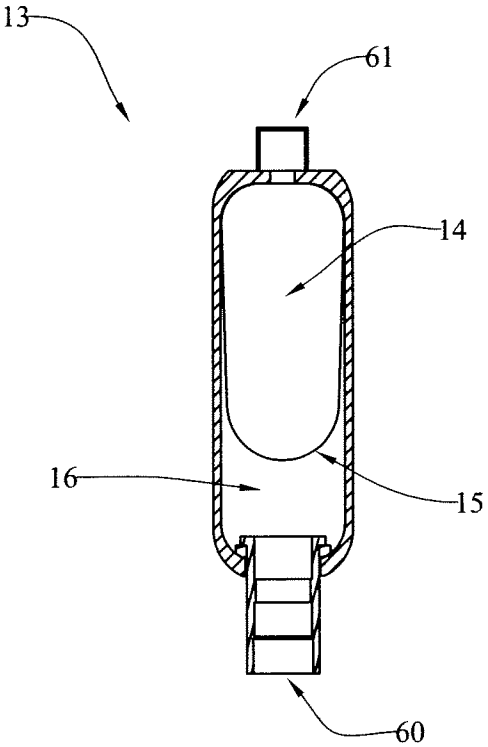
FIG. 9 is a cross-sectional view of the reservoir and compensator shown in FIG. 2.

As shown in further detail in FIG. 9, in this embodiment reservoir 13 includes a bladder type pressure compensator for the fluid system. As shown, reservoir 13 is separated into two variable volume chambers 14 and 16 by an elastomeric bladder or diaphragm 15. Chamber 16 is open to sea water via port 60, and chamber 14 operates as the hydraulic reservoir, through port 61, for system fluid and is sealed and pressure balanced from the outside environment 16 by bladder 15. As the system fluid is displaced, bladder 15 will move and displace water in chamber 16 on the other side. Bladder 15 is easy to move and ensures that the fluid inside is substantially equal to the ambient water pressure outside the system.

Figure 10:
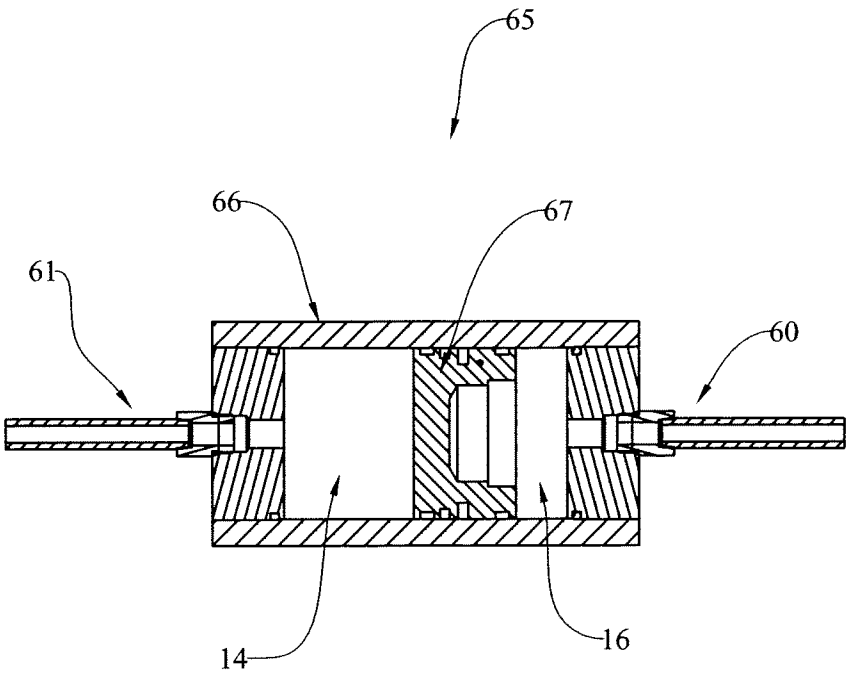
FIG. 10 is a cross-sectional view of an alternate embodiment of the reservoir and compensator shown in FIG. 9.

FIG. 10 shows an alternative piston type pressure compensator for reservoir 14. As shown, it functions generally the same as the bladder type, with the exception that the barrier between the system fluid in chamber 14 and the water in chamber 16 is piston 67, which is slidably disposed within cylindrical housing 66. As the system fluid is displaced, piston 67 will move and displace water in chamber 16 on the other side. Piston 67 moves in housing 66 to ensure that the fluid inside is substantially equal to the ambient water pressure outside the system.

Figure 6:
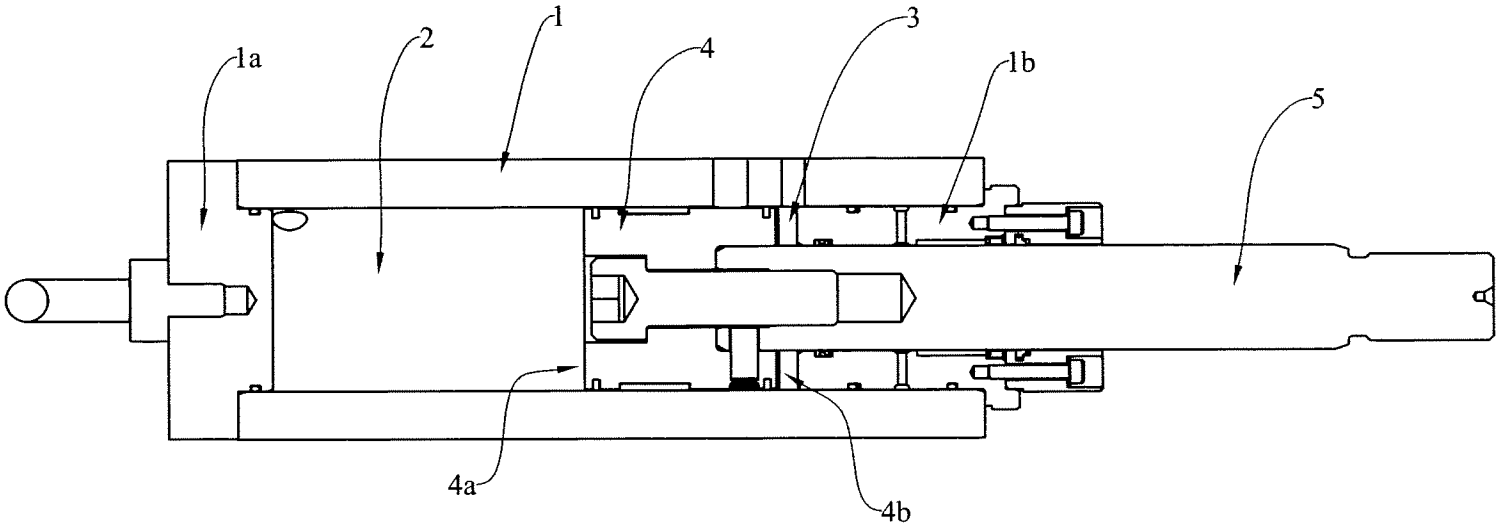
FIG. 6 is a cross-sectional view of the piston assembly shown in FIG. 2.

As shown in FIG. 2 and FIG. 6, piston assembly 101 includes piston 4 slidably disposed within cylindrical housing 1. Motor 10, pump 8, the valves and lines, and compensator 13 are typically integrated in housing 1. Rod 5 is mounted to piston 4 for movement with piston 4 and extends to the right and sealably penetrates right end wall **1*b* of housing 1. Piston 4 is slidably disposed within cylinder 1, and sealingly separates left chamber 2 from right chamber 3. In this embodiment, almost all of leftwardly-facing circular vertical end surface 4*a* of piston 4 faces into left chamber 2. However, only annular rightwardly-facing vertical end surface 4*b* of piston 4 faces rightwardly into right chamber 3 due to the addition of rod 5 through chamber 3 and outside housing 1. This creates an unequal piston area configuration, with the surface area of face 4***a* being greater than the surface area of face 4*b*.

As shown in FIG. 2, one side or port 8*a* of pump 8 communicates with left chamber 2 via fluid line 6, and the opposite side or port 8*b* of pump 8 communicates with right chamber 3 via fluid line 7. One side 8*a* of pump 8 communicates with tank 14 via fluid line 12 and the opposite side 8*b* of pump 8 communicates with tank 14 via fluid line 17. Chamber 3 communicates with tank 13 via lines 7 and 17, and chamber 2 communicates with tank 13 via lines 6 and 12.

Piston 4 will extend or move to the right when bidirectional motor 10 is rotated in a first direction, thereby rotating bidirectional pump 8 (namely driven gear 55) in first direction 46 and drawing fluid through port 8*b* from line 7 and chamber 3. Pilot operated check valve 11 is opened by the pressure built up in line 20 due to the output of pump 8 into line 6, which allows additional drawing of fluid from line 12 and reservoir 14. Bidirectional pump 8 also outputs fluid through port 8*a* into line 6, closing check valve 9 and thereby isolating line 6 from reservoir 14. The fluid in line 6 flows into chamber 2 of assembly 101, thereby creating a differential pressure on piston 4 and causing it to extend rod 5 to the right.

Piston 4 will retract rod 5 or move to the left when bidirectional motor 10 is rotated in the other direction, thereby rotating bidirectional pump 8 in direction 45 and drawing fluid through port 8*a* from line 6 and chamber 2. Pilot operated check valve 9 is opened by the pressure built up in line 19 due to the output of pump 8 into line 7, which allows additional fluid from line 6 to flow into system pressure compensated reservoir 14. Bidirectional pump 8 also outputs fluid from port 8*b* into line 7, closing check valve 11 and thereby isolating line 7 from reservoir 14. The fluid in line 7 flows into chamber 3 of assembly 101, thereby creating a differential pressure on piston 4 and causing it to retract rod 5.

The function of this anti-cavitation configuration is to address the volumetric differences between opposed chambers 2 and 3. For example, when piston 4 moves leftwardly within cylinder 1, the volume of fluid removed from collapsing left chamber 2 will be greater than the volume of fluid supplied to expanding right chamber 3.

Controller 95 controls the current to motor 10 at the appropriate magnitude and direction. The position of rod 5 is monitored via position transducer 40, and the position signals are then fed back to motor controller 95. In addition or alternatively, the pressure in lines 6 and 7 to chambers 2 and 3 are monitored with pressure transducers 41 and 42, respectively, and the pressure signals are fed back to motor controller 95. Variable speed bidirectional motor 10 and pump 8 control the speed and force of piston 4, and in turn rod 5, by changing the flow and pressure acting on piston 4. This is accomplished by looking at the feedback of position transducer 40 and/or pressure transducers 41 and 42 and then closing the control loop by adjusting the motor 10 speed and direction accordingly. While position sensor 40 is shown as a magnetostrictive linear position sensor, other position sensor may be used. For example, an LVDT position sensor may be used as an alternative.

Figure 3:
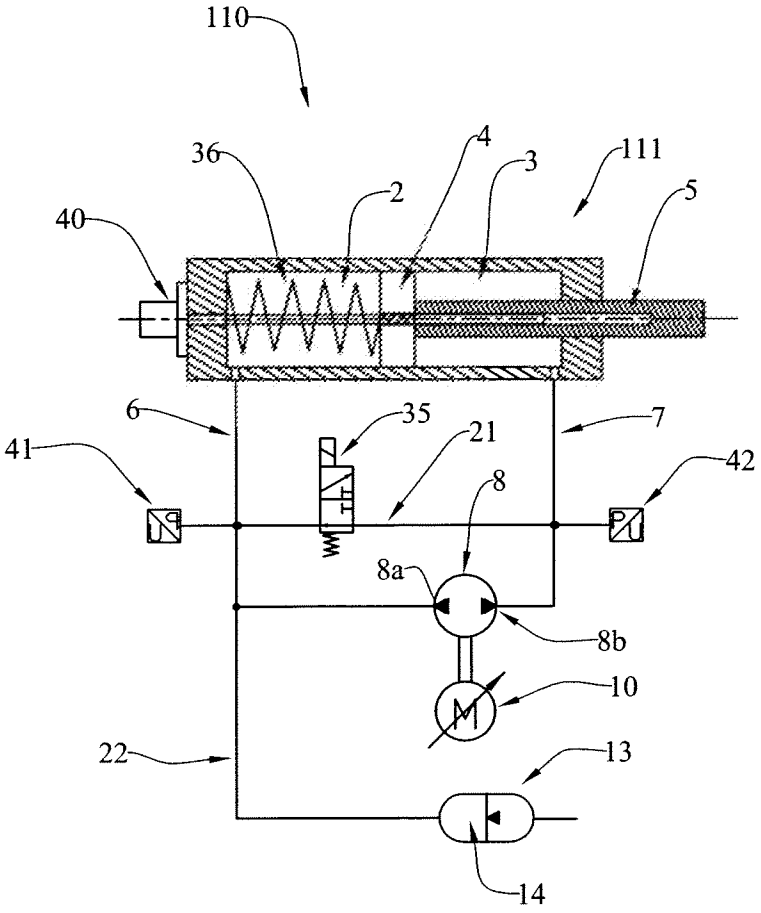
FIG. 3 is a detailed schematic view of a second embodiment of the subsea actuation system shown in FIG. 1, this view showing a spring fail-safe form.

Another embodiment 110 is shown in FIG. 3. This embodiment includes fail-safe mechanism 98, shown in FIG. 1, for when it becomes necessary to close valve 91, such as in an emergency situation. In this embodiment, springs 36 are provided to bias rod 5 towards an extended position. One side or port 8*a* of pump 8 communicates with left chamber 2 via fluid line 6, and the opposite side or port 8*b* of pump 8 communicates with right chamber 3 via fluid line 7. One side 8*a* of pump 8 communicates with tank 14 via fluid line 22 and the opposite side 8*b* of pump 8 does not include a fluid line to tank 14. Bypass fluid line 21 connects lines 6 and 7, and therefor chambers 1 anti 3, and solenoid-operated valve 35 is provided in line 21. Pump 8, piston assembly 111 and tank 14 are connected by a plurality of hydraulic flow lines 6, 7, 21 and 22 to form a closed fluid system. When in regular operation, valve 35 is energized so the state of valve 35 is blocked port, thereby blocking flow between chambers 2 and 3 through line 21. However, the solenoid valve is biased by a spring to move valve 35 to an open position.

Piston 4 will move to extend rod 5 when bidirectional motor 10 is rotated in a first direction, thereby rotating bidirectional pump 8 in first direction 45 and drawing fluid through port 8*b* from line 7 and chamber 3. Bidirectional pump 8 also outputs fluid into line 6 and tank 14. Since chamber 2 is always connected to tank 14, springs 36 force piston 4 to the right to extend rod 5.

Piston 4 will move left to retract rod 5 when bidirectional motor 10 is rotated the other direction, thereby rotating bidirectional pump 8 in other direction 46 and drawing fluid through port 8*a* from line 6. Bidirectional pump 8 also outputs fluid into line 7 and chamber 3. Since chamber 2 is always connected to reservoir 14, the differential piston force between the pressure from chamber 3 and springs 36 causes piston 4 to move to the left and retract rod 5.

Again, variable speed bidirectional motor 10 and pump 8 control the speed and force of piston 4 by changing the flow and pressure acting on piston 4 using feedback from position transducer 40 and/or pressure transducers 41 and 42 and then closing the control loop by adjusting the speed and direction of motor 10 accordingly.

When valve 35 is de-energized, such as in an emergency power loss, the spring of solenoid valve 35 will return it to an open position. In this state, chamber 3 is connected through line 21 to chamber 2 and to reservoir 14, thereby equalizing pressure in chambers 2 and 3. Since the fluid pressure is now equalized on each side of piston 4, springs 36 will extend rod 5, and valve 91 will close as fluid is transferred from chamber 3. Thus, regardless of pump 8 output, springs 36 will extend rod 5 and close valve 91. If desired, the system could be similarly arranged to provide a failsafe in the piston retracted position.

Figure 4:
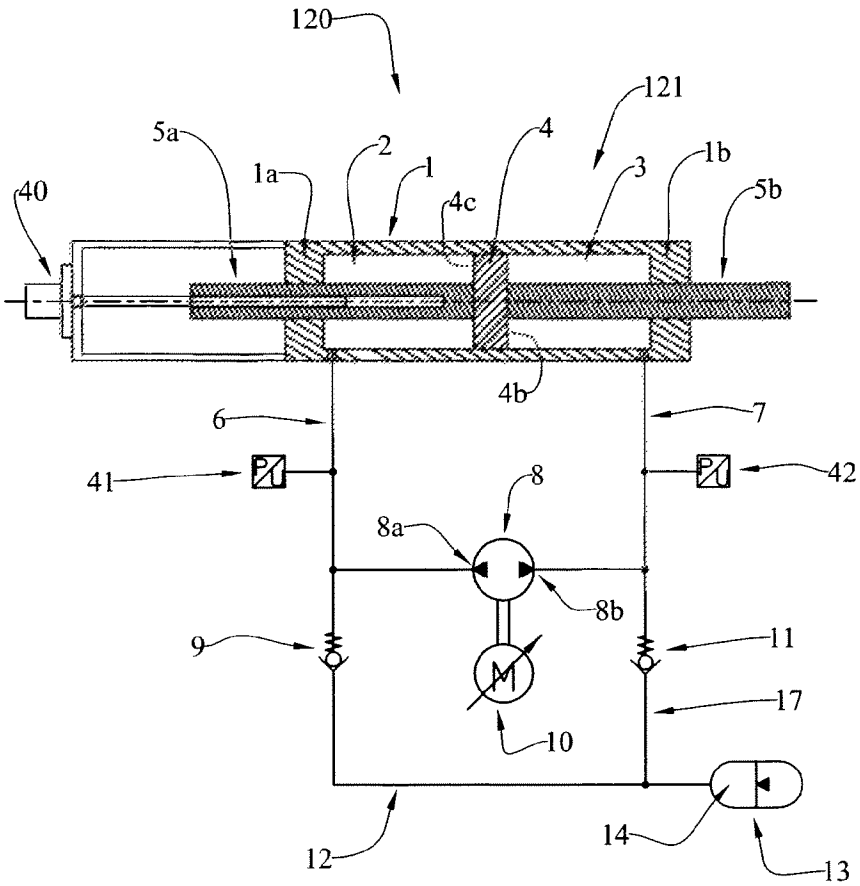
FIG. 4 is a detailed schematic view of a third embodiment of the subsea actuation system shown in FIG. 1, this view showing an equal piston area and dual rod form.

Another embodiment 120 is shown in FIG. 4. This embodiment is similar to the embodiment shown in FIG. 2, but with dual rod and equal area piston assembly 121. As shown, piston 4 includes opposed rods 5*a* and 5*b* mounted to piston 4 for movement with piston 4. Rod 5*b* extends to the right and penetrates the right end wall 1*b* of housing 1. Rod 5*a* extends to the left and penetrates the left end wall 1*a* of housing 1. In this embodiment, leftwardly-facing annular vertical end surface 4*c* of piston 4 faces into left chamber 2 due to the addition of rod 5*a* through chamber 2, and rightwardly-facing annular vertical end surface 4*b* of piston 4 faces into right chamber 3 due to rod 5*b* extending through chamber 3 and outside housing 1. With rods 5*a* and 5*b* being of an equal diameter, this creates an equal piston area configuration, with the surface area of face 4*c* being substantially the same as the surface area of face 4*b*. Pump 8, piston assembly 121 and tank 14 are connected by a plurality of hydraulic flow lines 6, 7, 12 and 17 to form a closed fluid system.

Piston 4 will move right to extend rod 5*b* and retract rod 5*a* when motor 10 is rotated in a first direction, thereby rotating bidirectional pump 8 in first direction 45 and drawing fluid through port 8*b* from line 7 and chamber 3. Pump 8 also outputs fluid into line 6 and chamber 2, creating a differential pressure on piston 4 and causing it to extend rod 5*b* and retract rod 5*a*.

Piston 4 will move to the left to retract rod 5*b* and extend rod 5*a* when bidirectional motor 10 is rotated the other direction, thereby rotating bidirectional pump 8 in direction 46 and drawing fluid through port 8*a* from line 6 and chamber 2. Bidirectional pump 8 also outputs fluid into line 7 and chamber 3, creating a differential pressure on piston 4 and causing it to retract rod 5*b* and extend rod 5*a*.

Again, variable speed bidirectional motor 10 and pump 8 control the speed and force of piston 4 by changing the flow and pressure acting on piston 4 using feedback from position transducer 40 and/or pressure transducers 41 and 42 and then closing the control loop by adjusting the motor 10 speed and direction accordingly.

Figure 5:
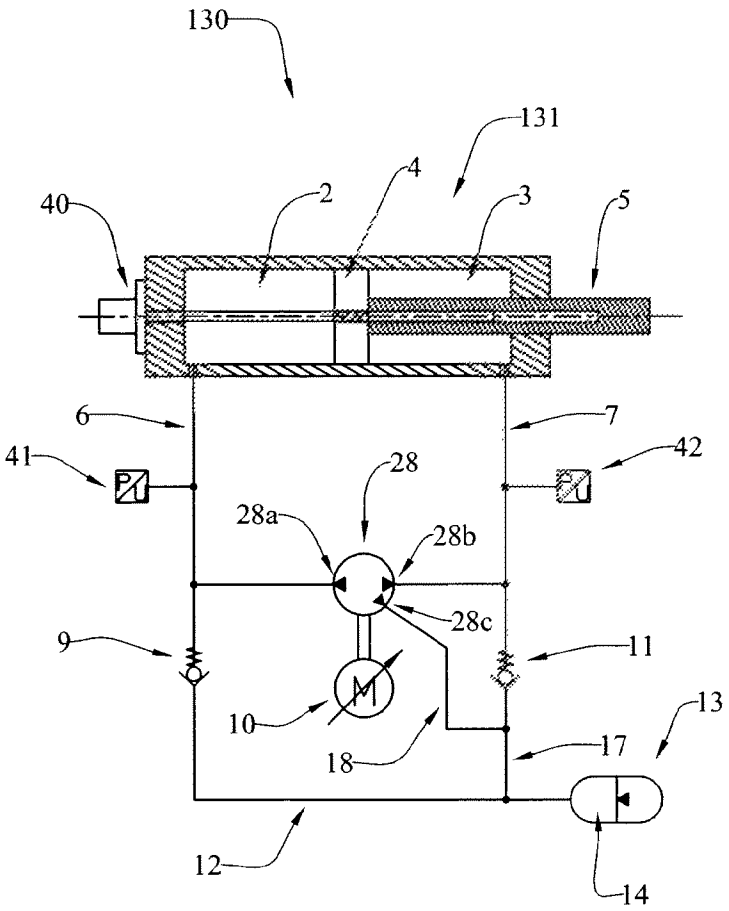
FIG. 5 is a detailed schematic view of a fourth embodiment of the subsea actuation system shown in FIG. 1, this view showing a three-port pump form.

Another embodiment 130 is shown in FIG. 5. This embodiment is similar to the embodiment shown in FIG. 2, but with a three port pump 28. In this embodiment, three-port pump 28, rather than two-port pump 8, is used and the 3 port input to output configuration ratio is matched to the piston area 4*a*/4*b* ratio. Third port 28*c* of pump 28 is connected by line 18 to tank 14. Pump 8, piston assembly 131 and tank 14 are connected by a plurality of hydraulic flow lines 6, 7, 12, 17 and 18 to form a closed fluid system.

Piston 4 will move right to extend rod 5 when bidirectional motor 10 is rotated in a first direction, thereby rotating bidirectional pump 28 in first direction 45 and drawing fluid through port 28*b* from line 7 and chamber 3 and through port 28*c* from line 18 and reservoir 14. Bidirectional pump 28 also outputs fluid from port 28*a* into line 6, closing check valve 9 and thereby isolating line 6 from reservoir 14. The fluid in line 6 flows into chamber 2, creating a differential pressure on piston 4 and causing it to extend rod 5.

Piston 4 will move left to retract rod 5 when bidirectional motor 10 is rotated the other direction, thereby rotating bidirectional pump 28 in the other direction 46 and drawing fluid through port 28*a* from line 6 and chamber 2. Bidirectional pump 28 outputs fluid from port 28*c* into lines 18 and 12 and reservoir 14 and also outputs fluid from port 28*b* into line 7, closing check valve 11 and thereby isolating line 7 from reservoir 14. The fluid in line 7 flows into chamber 3, creating a differential pressure on piston 4 and causing it to retract rod 5.

Again, variable speed bidirectional motor 10 and pump 8 control the speed and force of piston 4 by changing the flow 47 or 48 and pressure acting on piston 4 using feedback from position transducer 40 and/or pressure transducers 41 and 42 and then closing the control loop by adjusting the motor 10 speed and direction accordingly.

Check valves 9 and 11 will open to compensate for system fluid changes caused by actuator leakage to the outside environment or system fluid volume changes due to significant thermal changes. Although not shown, a filter unit may be installed in the fluid lines between pump 8 and chambers 2 and 3.

Actuation system 100 provides a number of benefits. Unexpectedly, system 100 provides actuating forces that are high enough to meet the rigorous demands of a subsea environment and subsea systems that require stringent standards and levels of functionality because of the dangers of an uncontrolled release of oil and gas. System 100 allows for variable speed actuation and full control of the location of the actuator within its range of motion. System 100 operates independently of a hydraulic system linked to the ocean surface and is a closed system with self-contained hydraulic supply and return porting and limited fluid contamination and leakage concerns. Power is not required when the system is not in use, which improves efficiency. System 100 also allows for fail safe features which have minimal impact on cost, weight or reliability.

The present invention contemplates that many changes and modifications may be made. Therefore, while an embodiment of the improved subsea actuation system has been shown and described, and a number of alternatives discussed, persons skilled in this art will readily appreciate that various additional changes and modifications may be made without departing from the spirit of the invention, as defined and differentiated by the following claims.

What is claimed is:

1. A subsea drilling, production or processing actuation system comprising:

a variable speed bidirectional electric motor adapted to be supplied with a current and to operatively provide a torque on an output shaft controllable at varying speeds and by direction;

a reversible variable speed hydraulic pump driven by said output shaft of said motor;

a hydraulic piston assembly connected to said pump and comprising a first chamber, a second chamber and a piston separating said first and second chambers and configured to actuate a valve in a subsea system within a range of motion of said valve;

a fluid reservoir connected to said pump and said hydraulic piston assembly;

said pump, hydraulic piston assembly and reservoir connected in a substantially closed hydraulic system; and a pressure compensator configured to normalize pressure differences between outside said hydraulic system and inside said hydraulic system;

whereby position of said valve within said range of motion is controllable by adjusting said speed and/or said direction of said motor.

2. The subsea actuation system set forth in claim 1, and further comprising a failsafe mechanism.

3. The subsea actuation system set forth in claim 2, wherein said fail-safe mechanism comprises a spring element biasing said piston in a first direction.

4. The subsea actuation system set forth in claim 3, wherein said fail-safe mechanism comprises a fail-safe valve between said first chamber and said second chamber or between said second chamber and said reservoir and wherein said fail-safe valve is arranged to open in the event of a power failure allowing equalization of fluid pressure in said first and second chamber on each side of said piston.

5. The subsea actuation system set forth in claim 2, wherein said fail-safe mechanism comprises a two-stage actuator.

6. The subsea actuation system set forth in claim 1, and further comprising a filter between said pump and said hydraulic piston assembly.

7. The subsea actuation system set forth in claim 1, wherein said electric motor comprises a brushless DC servo-motor.

8. The subsea actuation system set forth in claim 1, wherein said electric servo-motor is selected from a group consisting of a stepper motor, brush motor and induction motor.

9. The subsea actuation system set forth in claim 1, wherein said hydraulic pump is selected from a group consisting of a fixed displacement pump, a variable displacement pump, a two-port pump, and a three-port pump.

10. The subsea actuation system set forth in claim 1, wherein said pump comprises a two-port or a three-port pump.

11. The subsea actuation system set forth in claim 1, wherein said piston comprises a first surface area exposed to said first chamber and a second surface area exposed to said second chamber.

12. The subsea actuation system set forth in claim 11, wherein said first surface area is substantially equal to said second surface area.

13. The subsea actuation system set forth in claim 11, wherein said first surface area is substantially different from said second surface area.

14. The subsea actuation system set forth in claim 1, wherein said hydraulic piston assembly comprises:

a cylinder having a first end wall, wherein said piston is disposed in said cylinder for sealed sliding movement therealong; and a first actuator rod connected to said piston for movement therewith and having a portion sealingly penetrating said first end wall.

15. The subsea actuation system set forth in claim 14, wherein said cylinder has a second end wall and said hydraulic piston assembly comprises a second actuator rod connected to said piston for movement therewith and having a portion sealingly penetrating said second end wall.

16. The subsea actuation system set forth in claim 1, wherein said valve comprises a stop valve in a subsea blow-out preventer.

17. The subsea actuation system set forth in claim 16, wherein said stop valve comprises a shearing ram.

18. The subsea actuation system set forth in claim 1, wherein said valve comprises a control valve in a subsea production or processing system.

19. The subsea actuation system set forth in claim 1, wherein said pressure compensator comprises a membrane in said fluid reservoir.

20. The subsea actuation system set forth in claim 1, wherein said pressure compensator comprises a piston in a housing.

21. The subsea actuation system set forth in claim 1, wherein said valve is in an assembly selected from a group consisting of a subsea blow-out preventer, a subsea production tree or wellhead system, a subsea processing or separation system, a subsea tie-in system, a subsea chock, a subsea flow module or a subsea distribution system.

22. The subsea actuation system set forth in claim 1, and further comprising blocking valves operatively arranged to selectively isolate said pump from said first and second chambers.

23. The subsea actuation system set forth in claim 1, and further comprising a position sensor configured to sense the position of said piston.

24. The subsea actuation system set forth in claim 1, and further comprising a pressure sensor configured to sense pressure in said first and second chamber.

* * * * *